US006572090B2

(12) United States Patent
Susnjara

(10) Patent No.: US 6,572,090 B2
(45) Date of Patent: Jun. 3, 2003

(54) METHOD OF POSITIONING ARTICLES IN PREDETERMINED RELATIONSHIPS AND FIXTURE THEREFOR

(75) Inventor: Kenneth J. Susnjara, Birdseye, IN (US)

(73) Assignee: Thermwood Corporation, Dale, IN (US)

( * ) Notice: Subject to any disclaimer, the term of this patent is extended or adjusted under 35 U.S.C. 154(b) by 83 days.

(21) Appl. No.: 09/805,633

(22) Filed: Mar. 14, 2001

(65) Prior Publication Data

US 2002/0129483 A1 Sep. 19, 2002

(51) Int. Cl.[7] ..... B25B 3/00
(52) U.S. Cl. ..... 269/21; 269/41
(58) Field of Search ..... 269/21, 37, 41; 29/281.5; 279/3; 294/64.1; 451/388; 248/363, 362

(56) References Cited

U.S. PATENT DOCUMENTS 5,245,736 A * 9/1993 Schertler ..... 269/21
5,503,377 A * 4/1996 Plickert et al. ..... 269/21
6,264,185 B1 * 7/2001 Isobe et al. ..... 269/21

* cited by examiner

*Primary Examiner*—Robert C. Watson

(57) ABSTRACT

A fixture for positioning at least two articles in a predetermined relationship generally consisting of a body having at least two abutment surfaces disposed in such predetermined relationship, each of the surfaces having a port closeable upon positioning one of the articles on the surface in abutting relation therewith, in a passageway communicating with the port and communicable with a vacuum source; and a valve disposed in the passageway normally disposed in a closed position and operable to open upon positioning such article on such surface in abutting relation therewith.

22 Claims, 2 Drawing Sheets

METHOD OF POSITIONING ARTICLES IN PREDETERMINED RELATIONSHIPS AND FIXTURE THEREFOR

This invention relates to a method of securing at least two articles together in a predetermined relationship and a fixture for use in practicing such method.

BACKGROUND OF INVENTION

In a number of manufacturing operations, it often is required to position two or more articles such as panels made of wood, plastic and other materials, relative to each other and secure such articles together. Examples of such operations are the positioning of various panels in the manufacture of furniture and the positioning of various panels in the manufacture of cabinets, display stands and the like. Typically, such articles are positioned in predetermined relationships and fastened together by adhesives, mechanical fasteners or other means. The positioning of such articles traditionally has been accomplished either manually or by the use of various types of fixtures. Manual positioning, however, often has been found to be difficult, cumbersome or imprecise. Although the use of various types of fixtures have been found to be more expedient, such fixtures have been found to be comparatively expensive to manufacture, limited in application and time consuming to assemble for use. Accordingly, it is the principal object of the present invention to provide an improved method for positioning two or more articles in predetermined relationships to be secured together by various means which is simple in procedure and expedient to perform, and a novel fixture adapted for use in such method.

SUMMARY OF THE INVENTION

The present invention provides a simple and expedient method of positioning at least two articles in a predetermined relationship to permit such articles to be secured together, generally consisting of providing a fixture comprising a body having at least two abutment surfaces disposed in such predetermined relationship, each of such surfaces having a port closable upon positioning one of the articles on such surface in abutting relation therewith, and a passageway communicating with such port and communicable with a vacuum source, and a valve disposed in such passageway normally disposed in a closed position and operable to open upon positioning the article in abutting relationship on such surface; applying a vacuum to such passageway of the fixture; and then positioning such articles on the fixture surfaces in abutting relation to correspondingly cause such valves to open and thus apply a vacuum to the articles, further causing them to be retained in such predetermined relationship. With such articles retained in such predetermined relationships, they may be secured together by various means including adhesives, mechanical fasteners and any other suitable means.

DESCRIPTION OF THE PREFERRED EMBODIMENT

Figure 1:
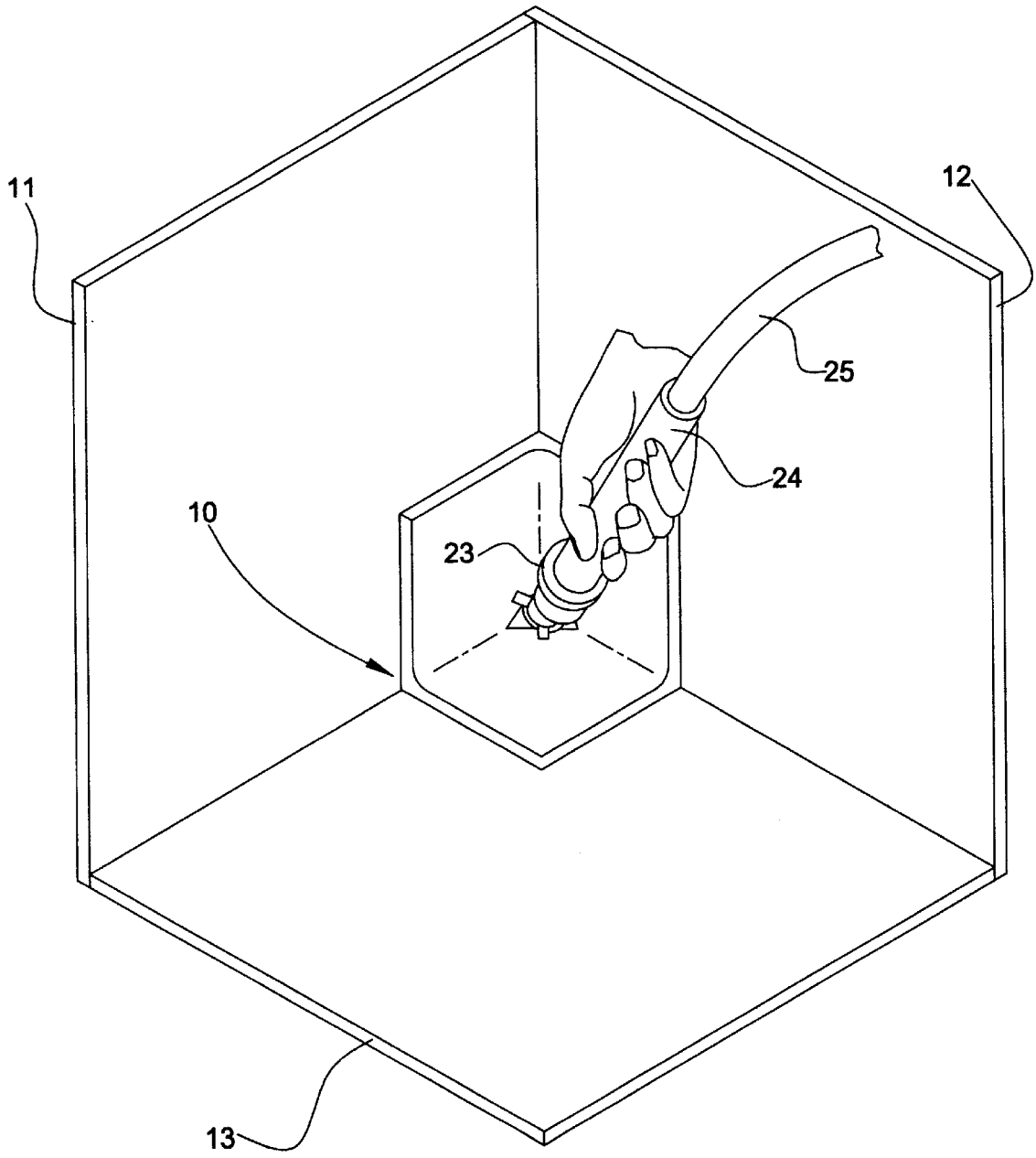
FIG. 1 is a perspective view of several panels positioned together by use of the method and a fixture embodying the present invention.
Figure 2:
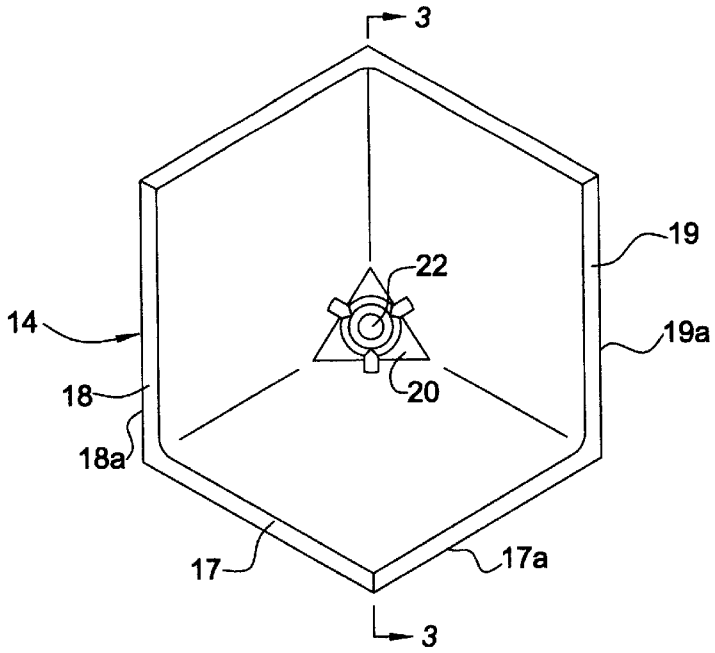
FIG. 2 is a perspective view of the fixture shown in FIG. 1.

Referring to the drawings, there is illustrated a fixture 10 adapted to position a set of panels 11, 12 and 13 in an orthogonal relationship. As best shown in FIGS. 2 through 5, the fixture includes a body 14 provided with a set of valves 15 and a set of seals 16. Body member 14 includes a bottom panel section 17, a pair of side panel sections 18 and 19 and a core section 20 disposed in the corner formed at the juncture of the panel sections. Outer surfaces 17*a,* 18*a* and 19*a* of the panel sections are planar, abutment surfaces disposed orthogonally and are provided with ports 17*b,* 18*b* and 19*b*.

Figure 3:
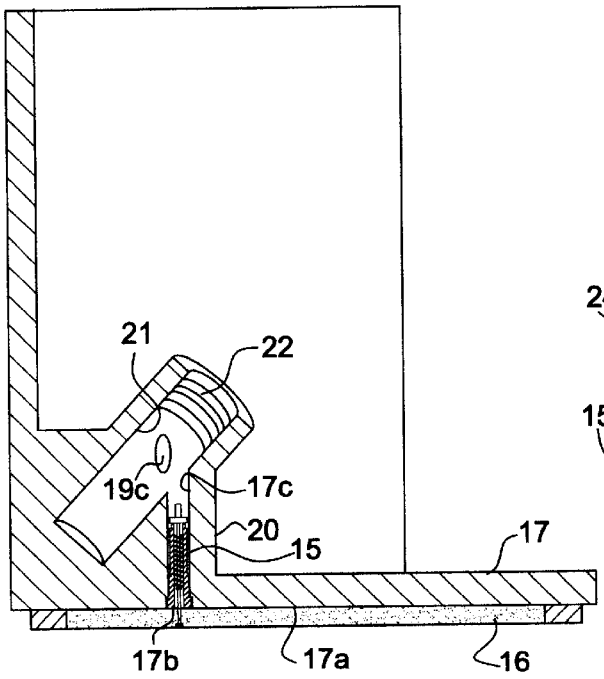
FIG. 3 is an enlarged cross-sectional view taken along line 3—3 in FIG. 2.

As best shown in FIGS. 1 and 3, core section 20 is provided with a main passageway 21 having a threaded port 22 adapted to receive the threaded end of a handle 24 connected to a vacuum hose 25. Handle 24 is adapted to be detachably connected to core section 20 of body member 14, and hose line 25 is adapted to be connected to a vacuum source to apply a vacuum to passageway 21. Core section 20 further is provided with a set of branch passageways 17*c,* 18*c* and 19*c* inter communicating main passageway 21 and ports 17*b,* 18*b* and 19*b,* respectively, of abutment surfaces 17*a,* 18*a* and 19*a*. Each of such abutment surfaces also is provided with a seal 16 adhesively secured to such surface and extending about the port of such surface as shown in FIG. 3.

Figure 4:
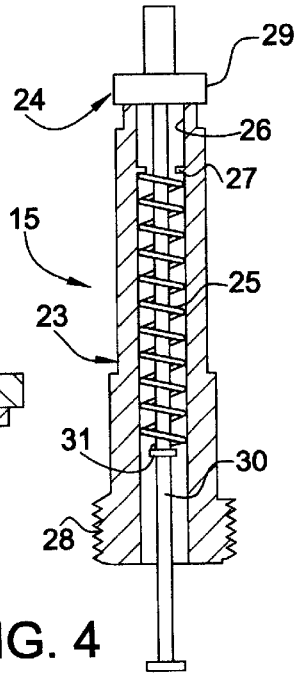
FIG. 4 is an enlarged cross-sectional view of the valve shown in FIG. 3, illustrating the valve in the closed condition.
Figure 5:
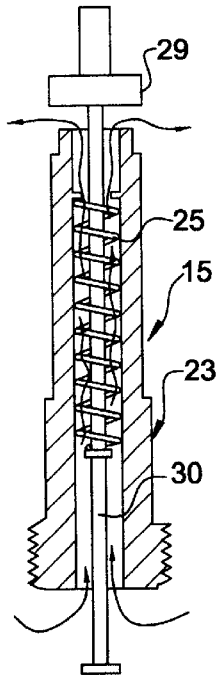
FIG. 5 is a view similarly to the view shown in FIG. 4, illustrating the valve in the open condition.

Disposed in each of branch passageways 17*b,* 18*b* and 19*b* is a valve 15. As shown in FIG. 4, each of such valves includes a housing 23, a valve 24 and a spring 25. Housing 23 is provided with a bore 26 therethrough, an annular, inwardly projection section 27 in an upper end of bore 26 and an external set of threads 28 at an opposite end thereof. Valve 24 includes a head portion 29 adapted to be seated on the upper annular end of the housing, forming a valve seat, and a stem portion 30 extending through bore 26 and projecting through and out of the outer end of the bore when head portion 29 is seated on the upper end of the housing. Intermediate the ends of the valve stem there is provided a collar portion 31. Spring 25 is disposed between annular section 27 and collar portion 31 to normally bias the valve in the closed position as shown in FIG. 4 with the free end of the valve stem projecting beyond the housing. The valve is adapted to open by displacing the valve relative to the housing thereof as shown in FIG. 5. Each of such valve assemblies is adapted to be inserted in a branch passageway 17*b,* 18*b* and 19*b* and retained-therein by means of the lower end thereof being threaded into such an opening, with the free end of the valve stem projecting beyond the adjacent abutment surface of the fixture.

Fixture 18 may be used to position panel members 11, 12 and 13 in an orthogonal relationship as shown in FIG. 1 to permit such panels to be joined together by means of an adhesive, mechanical fasteners or other means. In the use of the fixture, the leading end of handle 24 is first connected to the fixture and the vacuum source is caused to communicate with main passageway 21 of the core section of the fixture. With a vacuum thus applied to the fixture, it then may be positioned at a corner on the inner side of panel 13 to cause such panel to engage panel section 17 of the fixture in substantially abutting relation. As panel section 17 is positioned adjacent panel member 13, the valve stem of the valve disposed in branch passageway 17*c* will be engaged by panel member 13 and caused to displace axially against the biasing action of the spring thereof. As such valve stem displaces, the valve is caused to unseat and thus cause a vacuum to be applied to the area between panel section 17 and panel number 13. Seal 16 extending about port 17*b* and disposed between panel section 17 and panel member 13 forms a closed chamber to which a vacuum is applied with the opening of the valve in branch passageway 17*c* as described. Such action causes panel member 13 to be firmly held in position against abutment surface 17*a* of the fixture. Such procedure is repeated with respect to the positioning of panel members 11 and 12 to cause such panel members to be positioned as shown in FIG. 1.

In positioning the panel members as shown in FIG. 1, the panels further are positioned to provide mating surfaces on which an adhesive may be applied to permanently secure the panel members together in the position as shown. Alternatively, such abutting portions of the panel members may be joined together by mechanical fastening means such as nails, screws, brads, staples and the like.

The fixture may be formed of any material and fabricated in any conventional manner. It may be formed of a metal or plastic and may be formed as an integral unit or assembled from various components. Preferably, the fixture is injection molded from a plastic material as an integral unit. The passageways in the unit either may be molded in place or formed by drilling and tapping. Upon molding the unit with the openings therein, the several valves may easily be inserted and threaded in place. Alternatively, such openings may be drilled and tapped and the valves then inserted and threaded into such openings.

Although the embodiment as described is provided with three abutment surfaces having an orthogonal relationship, it is contemplated within the scope of the invention that the configuration of the abutment surfaces and their angular relationships may vary in accordance with the desired placement of the articles in position. Furthermore, the unit may be provided with up to five abutment surfaces permitting the positioning of five different articles.

In addition to the type of valve described in connection with the illustrated embodiment of the invention, it further is contemplated that any other device operable responsive to an article being positioned in abutting relation with one of the abutment surfaces to cause a vacuum to be applied between the fixture and the article to detachably retain the article in abutting relation with the abutment surfaces, may be used. As an example, a proximity switch may be used to sense the placement of an article in abutting relation with an abutment surfaces and operate in response to such sensing to open a valve to apply a vacuum to the port closed by the article being positioned. The type of valve described in connection with the aforementioned embodiment, however, is deemed to be most practical and economical for use in the present invention.

It further is contemplated that a number of such fixtures, differently configured, may be detachably secured to a vacuum hose to permit a workman assembling a number of articles together to select suitable fixtures for positioning such articles together. Such fixtures are deemed comparatively inexpensive to manufacture and simple to use in assembling various articles such as furniture pieces, cabinet panels and the like.

From the foregoing detailed description, it will be evident that there are a number of changes, adaptations and modifications of the present invention which come within the province of those persons having ordinary skill in the art to which the aforementioned invention pertains. However, it is intended that all such variations not departing from the spirit of the invention be considered as within the scope thereof as limited solely by the appended claims.

I claim:

1. A fixture for positioning at least two articles in a predetermined relationship comprising:

a body having at least two abutment surfaces disposed in said predetermined relationship, each of said surfaces having a port closeable upon positioning one of said articles on said each surface in abutting relation therewith, and a passageway communicating with said port and communicable with a vacuum source; and a valve disposed in a portion of said passageway adjacent to said port normally disposed in a closed position and moves to an open position upon positioning said one article on said surface in abutting relation therewith.

2. A fixture according to claim1 including a seal disposed on said each surface extending about said port and engageable by said article when said article is postioned on said each surface in abutting relation therewith.

3. A fixture according to claim 1 wherein said abutment surfaces are planar.

4. A fixture according to claim 3 including a seal disposed on said each surface extending about said port and engageable by said article consisting of a panel.

5. A fixture according to claim 3 including a pair of said surfaces lying in planes disposed at a selected angle relative to each other and wherein said articles consist of panels.

6. A fixture according to claim 5 wherein said surfaces are displaced 90° apart.

7. A fixture according to claim 6 including a seal disposed on each of said surfaces, extending about said port thereof and engageable by one of said articles consisting of a panel.

8. A fixture according to claim 3 including three of said surfaces lying in planes displaced at selected angles relative to each other and wherein said articles consist of panels.

9. A fixture according to claim 8 wherein the planes of said surfaces are orthogonal.

10. A fixture according to claim 8 including a seal disposed on each of said surfaces extending about said ports thereof and engageable by said articles consisting of panels.

11. A fixture for positioning at least two articles in a predetermined relationship comprising:

a body having at least two abutment surfaces disposed in said predetermined relationship, each of said abutment surfaces having a port closeable upon positioning one of said articles on said each surface in an abutting relation therewith and a passageway communicating with said port and communicable with a vacuum source; and a valve disposed in a portion of said passageway adjacent to said port including a member normally biased in a first position precluding passage of air therethrough, and having a portion projecting through the port of said one of said surfaces and displaceable upon engagement by said article and positioning of said article on said one of said surfaces in abutting relation therewith, in a second position, permitting passage of air therethrough.

12. A fixture according to claim 11 including a seal disposed on said each of said surfaces, extending about the port thereof and engageable by said article when said article is positioned in abutting relation with said surface.

13. A fixture according to claim 11 wherein said surfaces are planar.

14. A fixture according to claim 13 including a seal disposed on said each surface extending about said port and engageable by said article consisting of a panel.

15. A fixture according to claim 13 including a pair of said surfaces lying in planes displaced at a selected angle relative to each other and wherein said articles consist of panels.

16. A fixture according to claim 15 wherein said surfaces are displaced 90° apart.

17. A fixture according to claim 16 including a seal disposed on each of said surfaces extending about said ports thereof and engageable by said articles consisting of panels.

18. A fixture according to claim 13 including three of said surfaces lying in planes displaced a selected angles relative to each other and wherein said articles consist of panels.

19. A fixture according to claim 18 wherein said planes of said surfaces are orthogonal.

20. A fixture according to claim 18 including a seal disposed on each of said surfaces, extending about said ports thereof and engageable by said articles consisting of panels.

21. A fixture according to claim 11 wherein said valve includes a body disposed in said passageway and provided with a valve seat, a displaceable valve element having a head portion engageable with said valve seat to preclude passage of air through said valve body and a stem portion projectable through said port of said one of said surfaces, engageable by an article position on said one of said surfaces and means for biasing said valve element seated on said valve seat.

22. A fixture according to claim 21 wherein said biasing means comprises a spring disposed between said valve body and said valve element.

* * * * *